US008562286B2

(12) United States Patent
Gleiner et al.

(10) Patent No.: US 8,562,286 B2
(45) Date of Patent: Oct. 22, 2013

(54) DEAD ENDED BULBED RIB GEOMETRY FOR A GAS TURBINE ENGINE

(75) Inventors: Matthew S. Gleiner, Vernon, CT (US); Douglas C. Jenne, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 690 days.

(21) Appl. No.: 12/754,704

(22) Filed: Apr. 6, 2010

(65) Prior Publication Data

US 2011/0243717 A1 Oct. 6, 2011

(51) Int. Cl.
*F01D 5/18* (2006.01)

(52) U.S. Cl.
USPC ..... 415/115; 416/96 R

(58) Field of Classification Search
USPC ..... 415/115, 116; 416/96 R, 97 R
See application file for complete search history.

(56) References Cited

U.S. PATENT DOCUMENTS

| | | | | |
|---|---|---|---|---|
| 5,073,086 | A * | 12/1991 | Cooper | 416/96 R |
| 5,738,490 | A | 4/1998 | Pizzi | |
| 6,176,677 | B1 | 1/2001 | Chevrefils et al. | |
| 6,508,620 | B2 | 1/2003 | Sreekanth et al. | |
| 6,595,750 | B2 * | 7/2003 | Parneix et al. | 416/97 R |
| 6,832,893 | B2 | 12/2004 | Chevrefils et al. | |
| 6,939,102 | B2 * | 9/2005 | Liang | 415/115 |
| 7,137,780 | B2 | 11/2006 | Liang | |
| 7,303,376 | B2 | 12/2007 | Liang | |
| 7,357,623 | B2 | 4/2008 | Leghzaouni et al. | |
| 7,427,188 | B2 | 9/2008 | Neuhoff et al. | |
| 7,431,562 | B2 * | 10/2008 | Hooper et al. | 416/97 R |
| 7,435,053 | B2 | 10/2008 | Liang | |
| 7,473,073 | B1 | 1/2009 | Liang | |
| 7,527,474 | B1 | 5/2009 | Liang | |
| 7,527,475 | B1 | 5/2009 | Liang | |
| 7,547,190 | B1 | 6/2009 | Liang | |
| 7,547,191 | B2 | 6/2009 | Liang | |
| 7,568,887 | B1 | 8/2009 | Laing | |
| 7,584,538 | B2 | 9/2009 | Lee | |
| 7,600,966 | B2 | 10/2009 | Devore et al. | |
| 7,625,179 | B2 | 12/2009 | Cunha et al. | |
| 7,645,122 | B1 | 1/2010 | Liang | |
| 8,052,389 | B2 * | 11/2011 | Kopmels | 416/96 R |
| 2006/0280606 | A1 * | 12/2006 | Busbey et al. | 416/97 R |
| 2007/0104576 | A1 * | 5/2007 | Cunha et al. | 416/97 R |

OTHER PUBLICATIONS

Airfoil Internal Dead Ended Bulbed Rib Geometry, redacted drawing from previous Pratt & Whitney work.

* cited by examiner

*Primary Examiner* — Nathaniel Wiehe
*Assistant Examiner* — Joshua R Beebe
(74) *Attorney, Agent, or Firm* — Carlson, Gasky & Olds, P.C.

(57) ABSTRACT

A component within a gas turbine engine includes a dead ended rib which at least partially defines an internal cooling circuit flow path, the dead ended rib defines a bulbed rib profile.

17 Claims, 7 Drawing Sheets

DEAD ENDED BULBED RIB GEOMETRY FOR A GAS TURBINE ENGINE

STATEMENT REGARDING FEDERALLY SPONSORED RESEARCH OR DEVELOPMENT

This disclosure was made with Government support under F33615-03-D-2354-0009 awarded by The United States Air Force. The Government has certain rights in this disclosure.

BACKGROUND

The present disclosure relates to a gas turbine engine, and more particularly to a cooling circuit with a dead ended rib geometry.

A gas turbine engine includes one or more turbine stages each with a row of turbine rotor blades secured to an outer perimeter of a rotor disk and a stationary turbine nozzle assembly adjacent thereto with a row of stator vanes. Hot combustion gases flow along the stator vanes and the turbine blades such that the turbine vanes and turbine blades are typically internally cooled with compressor air bled from a compressor section through one or more internal cooling passages or other types of cooling circuits contained therein.

The serpentine cooling passages or other types of cooling circuits often include a dead ended rib which may be subject to stress concentrations from the centrifugal forces applied to the dead ended rib. Although current designs may be effective, further reductions in stress concentrations facilitate an increase in Low Cycle Fatigue life, increased fracture life, and improved overall durability of such actively cooled components.

SUMMARY

A component within a gas turbine engine according to an exemplary aspect of the present disclosure includes a dead ended rib which at least partially defines a cooling circuit section of a cooling circuit flow path, the dead ended rib defines a bulbed rib profile.

An airfoil within a gas turbine engine according to an exemplary aspect of the present disclosure includes a rotor blade that includes a platform section between a root section and an airfoil section. The rotor blade defines an internal cooling circuit flow path with an inlet through the root section. A dead ended rib at least partially defines a cooling circuit section of the cooling circuit flow path in which the dead ended rib defines a bulbed rib profile.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
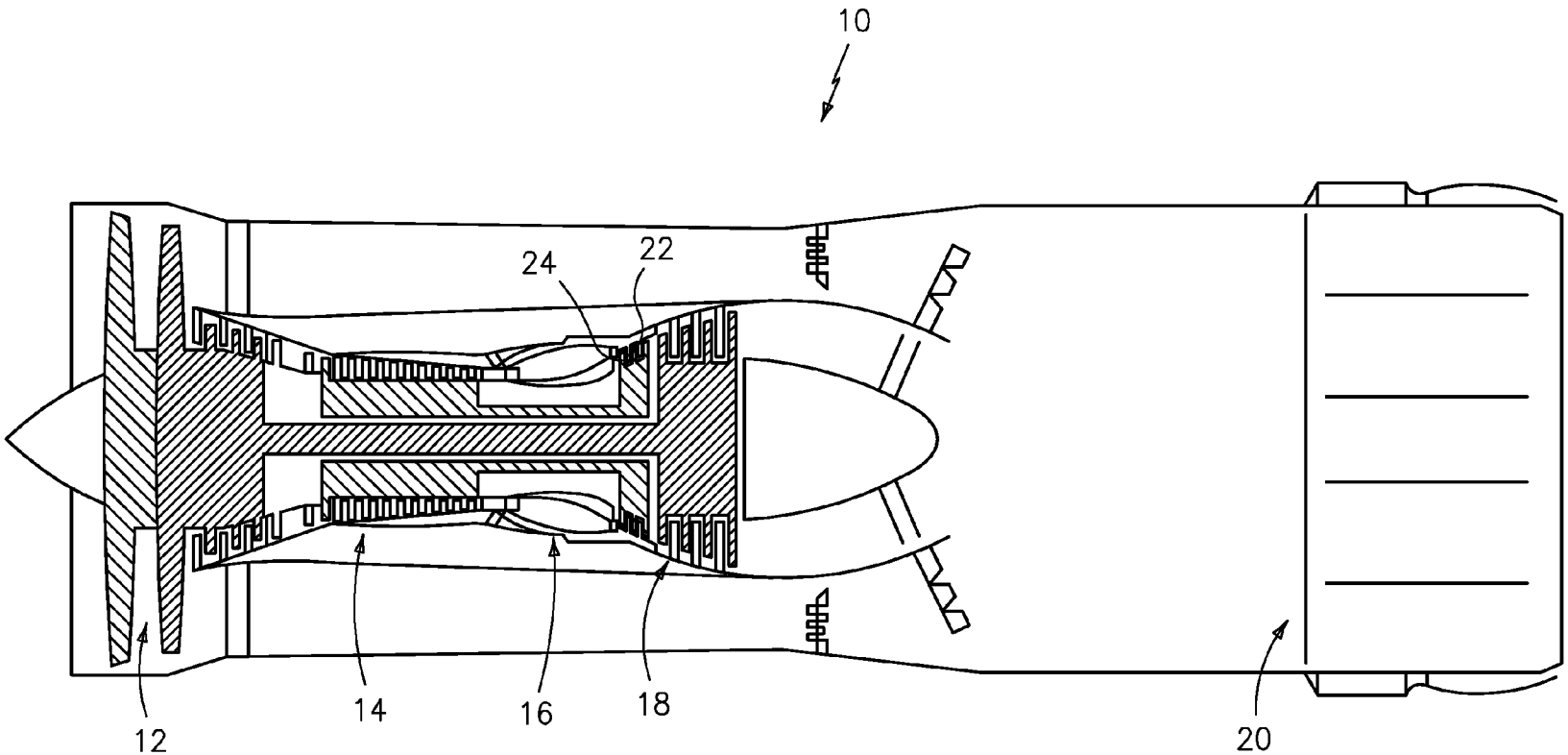
FIG. 1 is a sectional view of a gas turbine engine.

FIG. 1 schematically illustrates a gas turbine engine 10 which generally includes a fan section 12, a compressor section 14, a combustor section 16, a turbine section 18, and a nozzle section 20. Within and aft of the combustor section 16, engine components are typically internally cooled due to intense temperatures of the hot combustion core gases.

For example, a turbine rotor 22 and a turbine stator 24 includes a multiple of internally cooled components 28 such as a respective multiple of turbine blades 32 and turbine vanes 35 (FIG. 2) which are cooled with a cooling airflow typically sourced as a bleed airflow from the compressor section 14 at a pressure higher and temperature lower than the combustion gases within the turbine section 18. While a particular gas turbine engine is schematically illustrated in the disclosed non-limiting embodiment, it should be understood that the disclosure is applicable to other gas turbine engine configurations, including, for example, gas turbines for power generation, turbojet engines, high bypass turbofan engines, low bypass turbofan engines, turboshaft engines, etc.

Figure 2:
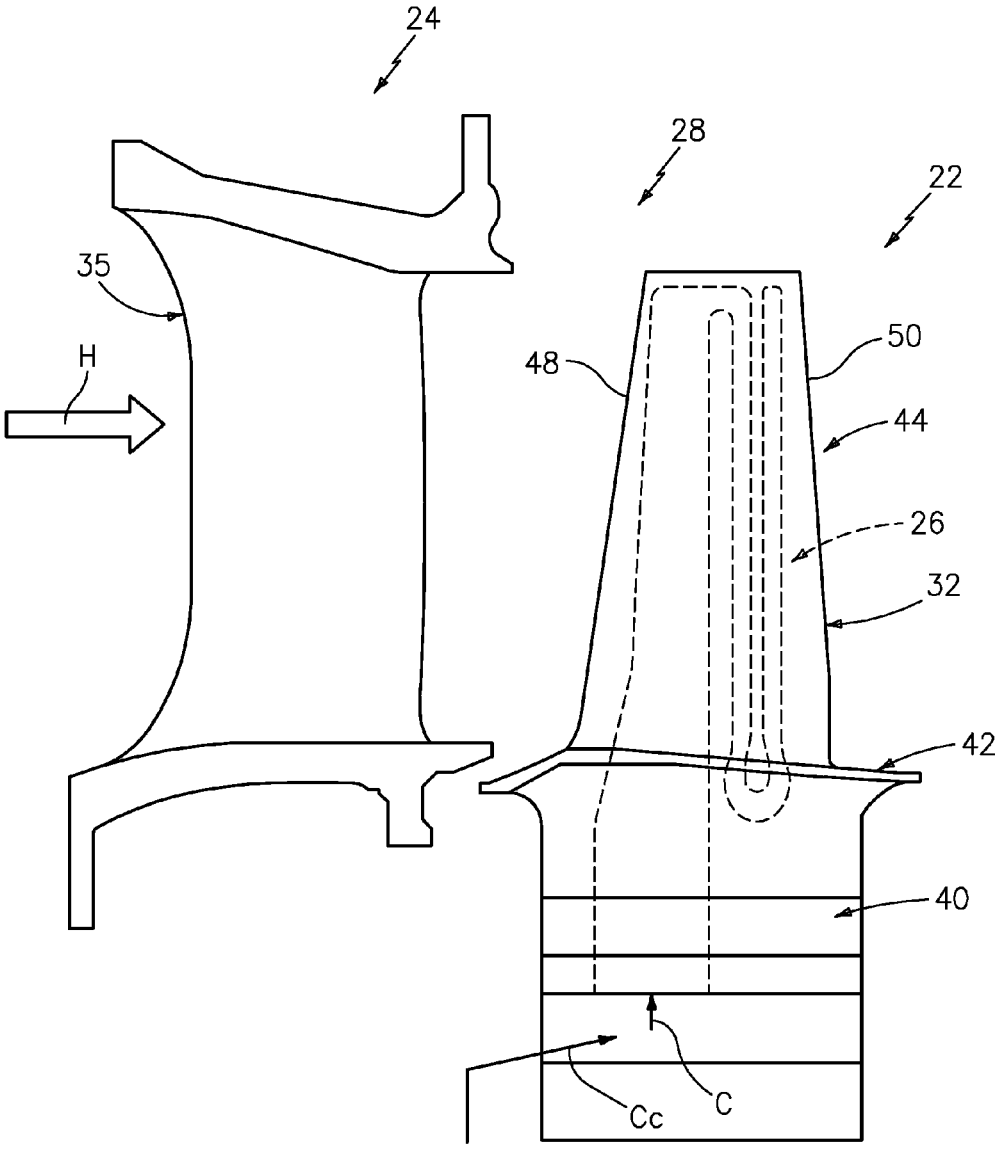
FIG. 2 is an expanded sectional view of internally cooled turbine stage components within the gas turbine engine of FIG. 1.

Referring to FIG. 2, the cooling airflow passes through at least one cooling circuit flow path 26 to transfer thermal energy from the component 28 to the cooling airflow. The cooling circuit flow path 26 may be disposed in any component 28 of the engine 10 that requires cooling, so that the component receives cooling airflow therethrough as the external surface thereof is exposed to hot combustion gases. In the illustrated embodiment and for purposes of a detailed example, the cooling circuit flow path 26 will be primarily described herein as being disposed within the turbine blade 32. It should be understood, however, that the cooling circuit flow path 26 is not limited to this application alone and may be utilized within other areas such as vanes, liners, blade seals, and others which are also actively cooled.

Figure 3A:
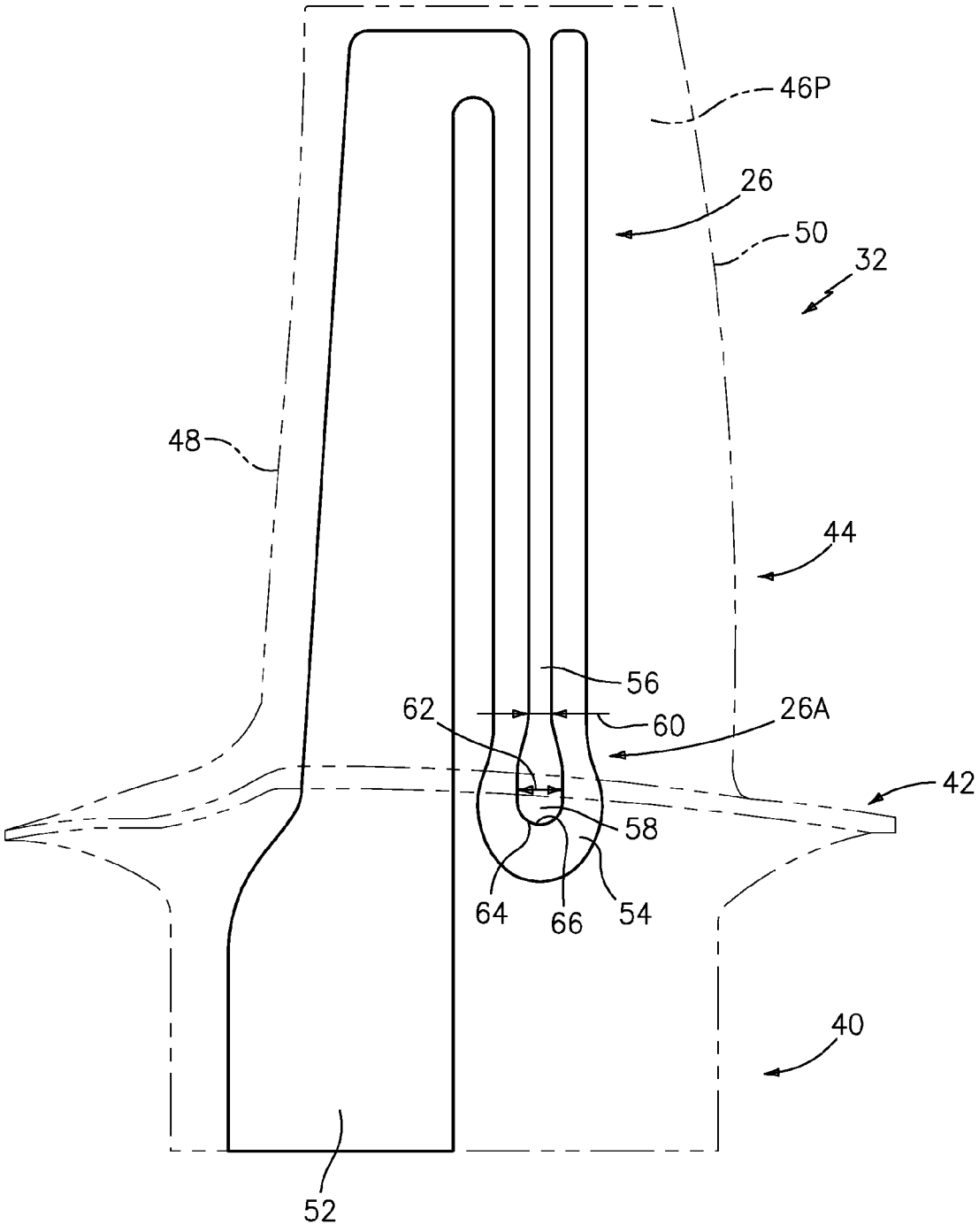
FIG. 3A is a pressure side partial phantom view of a turbine blade illustrating a cooling circuit flow path therein.
Figure 3B:
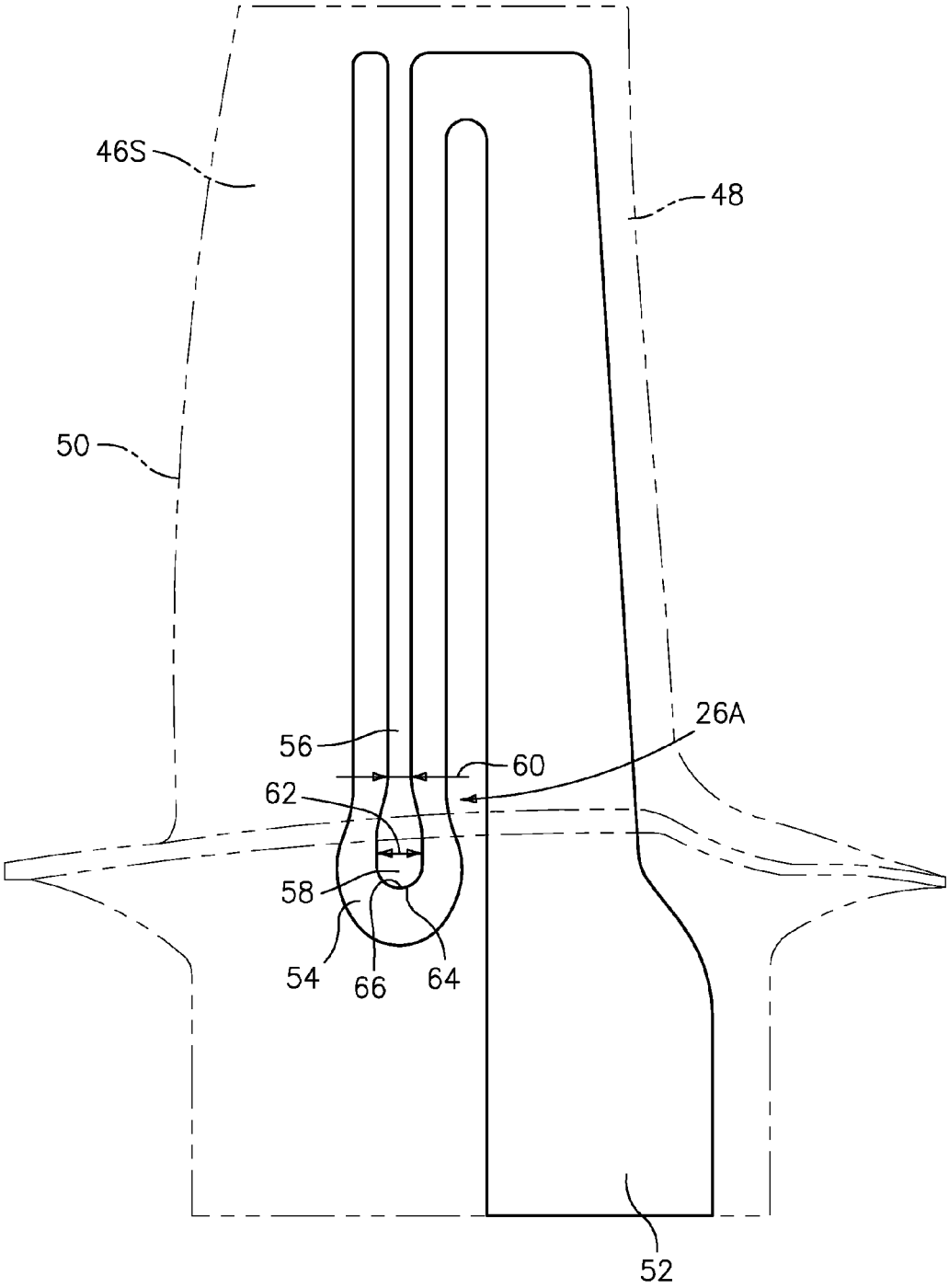
FIG. 3B is a suction side partial phantom view of a turbine blade illustrating a cooling circuit flow path therein.

Referring to FIGS. 3A and 3B, the turbine blade 32 generally includes a root section 40, a platform section 42, and an airfoil section 44. The airfoil section 44 is defined by an outer airfoil wall surface 46 between the leading edge 48 and a trailing edge 50. The outer airfoil wall surface 46 defines a generally concave shaped portion which defines a pressure side 46P (FIG. 4A) and a generally convex shaped portion forming a suction side 46S.

Hot combustion gases H flow around the airfoil section 44 above the platform section 42 while cooler high pressure air (C) pressurizes a cavity (Cc) under the platform section 42. The cooler high pressure air (C) is typically sourced with a bleed airflow from the compressor section 14 at a pressure higher and temperature lower than the core gas within the turbine section 18 for communication into the cooling circuit flow path 26 though at least one inlet 52 defined within the root section 40. The cooling circuit flow path 26 is arranged from the root section 40 through the platform section 42 and into the airfoil section 44 for thermal communication with high temperature areas of the airfoil section 44.

The cooling circuit flow path 26 typically includes a serpentine circuit 26A with at least one area that forms a turn 54. A dead ended rib 56 is located between the pressure side 46P and the suction side 46S to at least partially define the turn 54. In one non-limiting embodiment, the turn 54 is located generally within the platform section 42. It should be understood that various locations may alternatively or additionally be provided.

Figure 4:
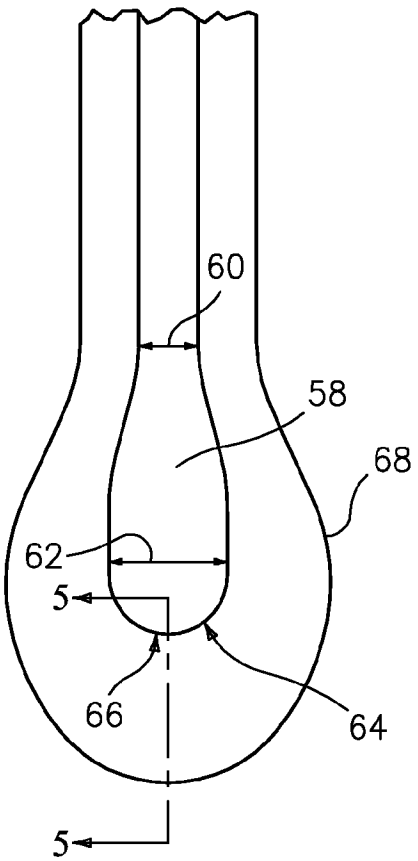
FIG. 4 is an expanded view of a dead ended rib that includes a bulbed rib profile to at least partially define a serpentine circuit section of the cooling circuit flow path according to one non-limiting embodiment.
Figure 9:
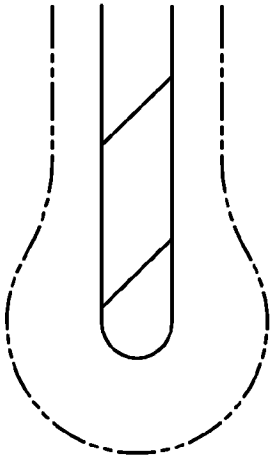
FIG. 9 (RELATED ART)
FIG. 9 is a schematic view of a RELATED ART dead ended rib.

The dead ended rib 56 includes a bulbed rib profile 58 in which the rib thickness at a first rib location 60 is less than a rib thickness at a second rib location 62 (FIG. 4). The second rib location 62 generally includes a distal end 64 of the dead ended rib 56 (FIG. 4). That is, the bulbed rib profile 58 essentially forms a light bulb type shape as compared with related art designs which may have higher stress concentrations (RELATED ART; FIG. 9).

Figure 5:
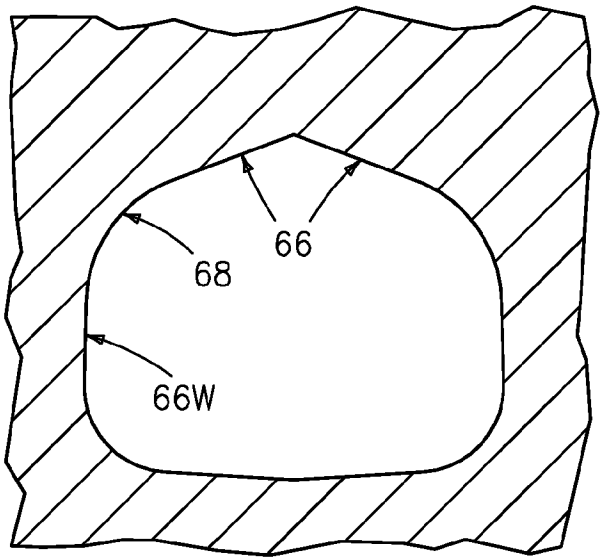
FIG. 5 is an expanded sectional view taken along line 5-5 in FIG. 4 to illustrate a rib draft of the bulbed rib profile.

The dead ended rib 56 may also include a rib draft 66 (FIG. 5). The rib draft 66 is essentially a pinched area about the outer periphery of the dead ended rib 56. A draft as defined herein is synonymous with a taper. As disclosed in the non-limiting illustrated embodiment, the surfaces labeled 66 are the draft surfaces which, instead of being completely horizontal, are angled down (tapered). This is for tool design as well as for stress reduction. The rib draft 66 may be applied to the pressure side, the suction side, or both.

Figure 6:
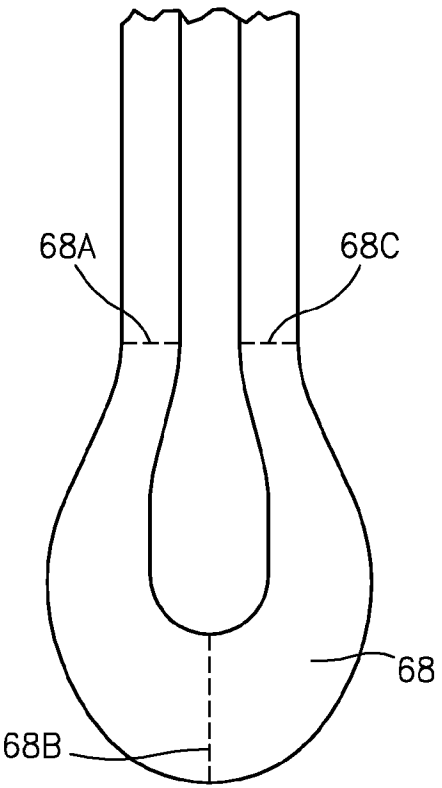
FIG. 6 is an expanded perspective view of a variable sized blend of the bulbed rib profile.

The dead ended rib 56 may also include a variable sized blend 68 (FIG. 6). The variable sized blend 68 may be defined at least about the bulbed rib profile 58. The variable sized blend 68 around the bulbed rib profile 58 obtains, in one non-limiting embodiment, the largest blend size 68B at the distal end 64. That is, the distal end 64 in one non-limiting embodiment, maximizes the radius of the blend. The variable sized blend 68 as defined herein refers to a radius that provides a smooth transition between two surfaces and in which the size of this radius is changing along the distance of the blend. In the non-limiting illustrated embodiment, the variable sized blend 68 provides a smooth transition between surfaces 66 and 66W (FIG. 5). The size of the blend 68 changes from location 66A to location 66B, and from location 68B to location 66C, where the largest blend size is at location 66B and the blend size at location 66A may or may not equal the blend size at location 66C. The variable sized blend 68 may be applied to the pressure side, the suction side, or both dependent at least on the stress concentrations. The bulbed rib profile 58, rib draft 66 and variable sized blend 68 provide a combination of geometries which maximize stress reduction. That is, the bulbed rib profile 58, rib draft 66 and variable sized blend 68 operate alone and in combination to facilitate a reduction of stress concentrations to which the dead ended rib 56 may be subject. Each feature as well as various combinations thereof facilitates the stress distribution around the turn 54 such that stress is directed away from the dead ended portion of the rib to increase Low Cycle Fatigue life, increase fracture life and improve overall durability requirements of actively cooled components which have a dead ended rib.

Figure 7:
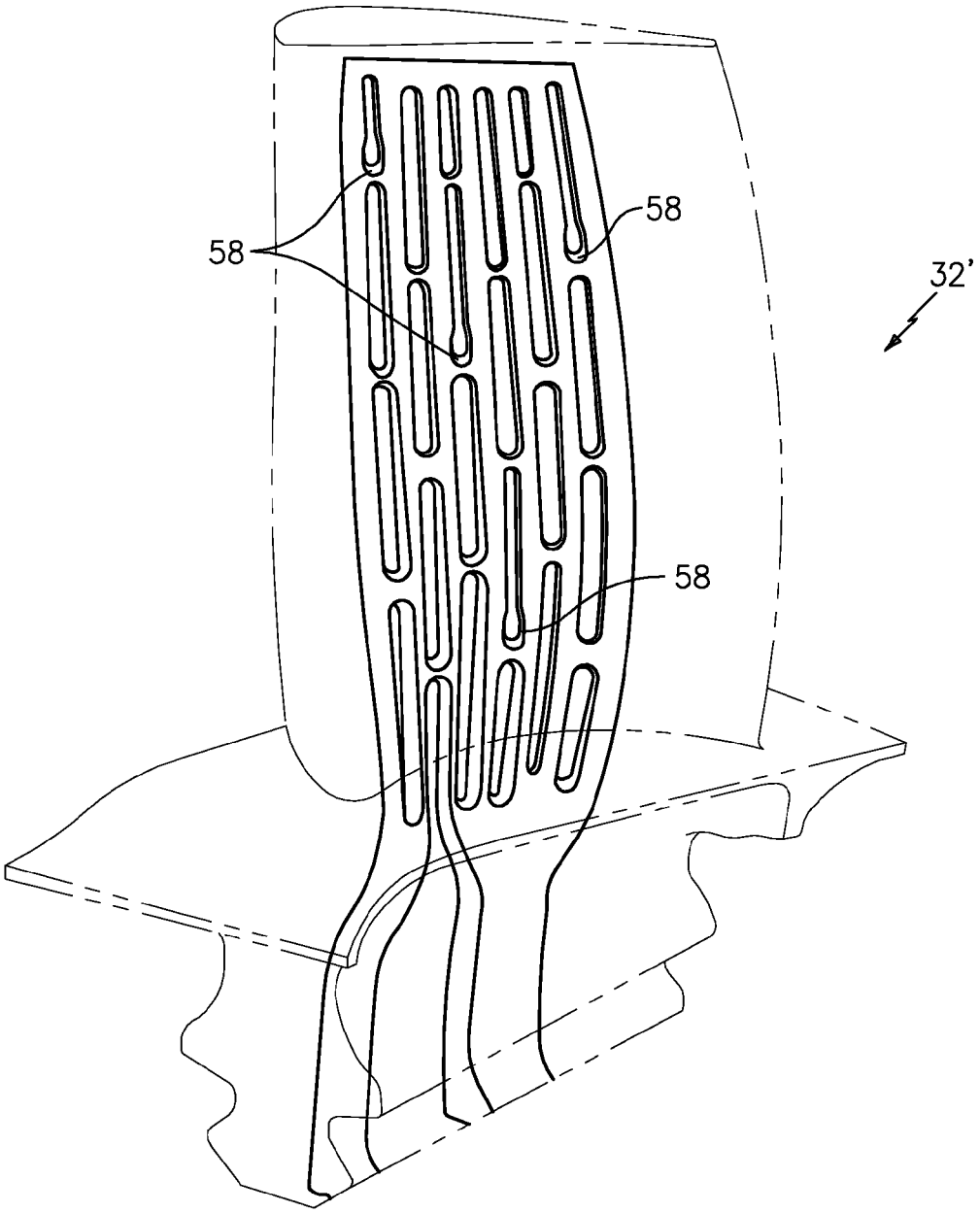
FIG. 7 is a perspective view of another non-limiting embodiment dead ended rib with a bulbed rib profile internal cooling channel arrangement within another internally cooled component.
Figure 8:
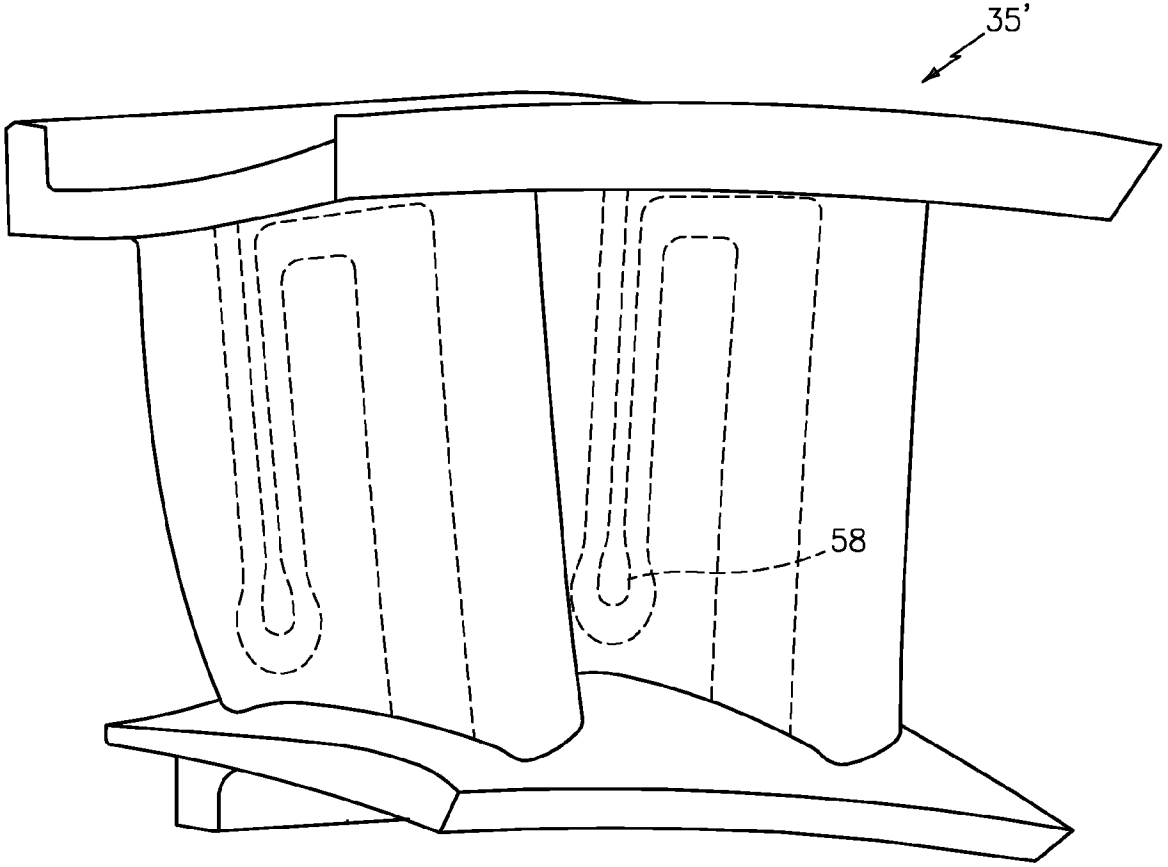
FIG. 8 is a perspective view of another non-limiting embodiment dead ended rib with a bulbed rib profile internal cooling channel arrangement within another internally cooled component.

The combination of bulbed rib profile 58, rib draft 66 and variable sized blend 68 rib features may be applied to any component with other internal cooling channels, such as of blades 32' (FIG. 7) as well as vanes 35' (FIG. 8). That is, any component with a dead ended rib, in addition to components which do not include airfoils such as static structures may alternatively or additionally benefit herefrom.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A component within a gas turbine engine comprising:

A dead ended rib which partially defines an internal cooling circuit flow path; and A side surface connecting said dead ended rib and a wall opposing said dead ended rib, so that all three define said internal cooling circuit flow path, Said dead ended rib defines a bulbed rib profile and includes a variable sized blend surface extending around a periphery of said bulbed rib profile, said variable size blend surface adjoining said bulbed rib profile and said side surface, said variable sized blend surface has a radius that changes along said internal cooling circuit flow path around said bulbed rib profile.

2. The component as recited in claim 1, wherein said component is a turbine blade.

3. The component as recited in claim 1, wherein said component is a turbine vane.

4. The component as recited in claim 1, wherein said dead ended rib ends within a platform section.

5. The component as recited in claim 1, wherein said bulbed rib profile defines a distal end of said dead ended rib.

6. The component as recited in claim 1, wherein said bulbed rib profile includes a rib draft.

7. The component as recited in claim 1, wherein said bulbed rib profile includes a rib draft that has a pinched area about a periphery thereof.

8. The component as recited in claim 1, wherein said bulbed rib profile includes a rib draft such that said bulbed rib profile includes adjoining tapered surfaces at a distal end thereof.

9. The component as recited in claim 1, wherein said radius of said variable sized blend surface increases along said internal cooling circuit flow path from one side of a base of said bulbed rib profile to a distal tip of said bulbed rib profile.

10. The component as recited in claim 9, wherein said radius decreases along said internal cooling circuit flow path from said distal tip to the other side of said base.

11. The component as recited in claim 1, wherein said radius of said variable sized blend surface along said internal cooling circuit flow path around said bulbed rib profile is maximum at a distal tip of said bulbed rib profile.

12. A cooled airfoil within a gas turbine engine comprising:

A rotor blade that includes an airfoil section, a platform section, and a root section, said platform section between said root section and said airfoil section, said rotor blade defines an internal cooling circuit flow path with an inlet through said root section;

A dead ended rib which partially defines said internal cooling circuit flow path; and A side surface connecting said dead ended rib and a wall opposing said dead ended rib, so that all three define said internal cooling circuit flow path, Said dead ended rib defines a bulbed rib profile and includes a variable sized blend surface extending around a periphery of said bulbed rib profile, said variable size blend surface adjoining said bulbed rib profile and said side surface, said variable sized blend surface has a radius that changes along said internal cooling circuit flow path around said bulbed rib profile.

13. The airfoil as recited in claim 12, wherein said bulbed rib profile defines a distal end of said dead ended rib.

14. The airfoil as recited in claim 12, wherein said bulbed rib profile includes a rib draft.

15. The airfoil as recited in claim 12, wherein said rotor blade is a turbine blade.

16. The airfoil as recited in claim 12, wherein said bulbed rib profile includes a rib draft that has a pinched area about a periphery thereof.

17. The airfoil as recited in claim 12, wherein said bulbed rib profile includes a rib draft such that said bulbed rib profile includes adjoining tapered surfaces at a distal end thereof.

* * * * *